US008995873B2

(12) United States Patent
Li et al.

(10) Patent No.: US 8,995,873 B2
(45) Date of Patent: Mar. 31, 2015

(54) SYSTEM AND METHOD FOR REFURBISHING PRINT CARTRIDGES AND PRINT CARTRIDGE TONER BLADES

(71) Applicant: Clover Technologies Group, LLC, Ottawa, IL (US)

(72) Inventors: Jun Li, Ottawa, IL (US); Paul Michael Korzenecki, Naperville, IL (US); Heymo Hormann, Wilmington, IL (US)

(73) Assignee: Clover Technologies Group, LLC, Ottawa, IL (US)

( * ) Notice: Subject to any disclaimer, the term of this patent is extended or adjusted under 35 U.S.C. 154(b) by 0 days.

(21) Appl. No.: 14/030,255

(22) Filed: Sep. 18, 2013

(65) Prior Publication Data

US 2014/0112683 A1 Apr. 24, 2014

Related U.S. Application Data

(60) Provisional application No. 61/703,503, filed on Sep. 20, 2012.

(51) Int. Cl.
*G03G 15/00* (2006.01)
*G03G 21/18* (2006.01)

(52) U.S. Cl.
CPC ..... *G03G 21/181* (2013.01)
USPC ..... 399/109

(58) Field of Classification Search
CPC ..... G03G 15/0812; G03G 15/0894; G03G 15/0898; G03G 21/181; G03G 21/1814
USPC ..... 399/109
See application file for complete search history.

(56) References Cited

U.S. PATENT DOCUMENTS

2002/0041777 A1* 4/2002 Sirejacob ..... 399/274

* cited by examiner

*Primary Examiner* — Walter L Lindsay, Jr.
*Assistant Examiner* — Ruth Labombard
(74) *Attorney, Agent, or Firm* — Matthew G. Gavronski

(57) ABSTRACT

A refurbished toner blade for a toner cartridge and a method for refurbishing a toner blade for a toner cartridge are provided. The refurbished toner blade includes a fixed portion configured for attachment to a portion of a toner cartridge, a depending portion extending away from the fixed portion, and a permanent deflection that is formed during refurbishment of the toner blade and that extends between the fixed portion and the depending portion. The refurbished toner blade is formed from a used toner blade in which the depending portion has obtained a permanent deformation in a first direction after an initial period of use. The permanent deflection deflects the depending portion in a second direction opposite the first direction.

35 Claims, 5 Drawing Sheets

SYSTEM AND METHOD FOR REFURBISHING PRINT CARTRIDGES AND PRINT CARTRIDGE TONER BLADES

CROSS REFERENCE TO RELATED APPLICATION

This application claims the benefit of and priority to U.S. provisional patent application no. 61/703,503, filed Sep. 20, 2012, the entire contents of which are hereby incorporated by reference herein.

TECHNICAL FIELD

The present invention relates generally to systems and methods for refurbishing print cartridges for a printer, and more particularly to systems and methods for refurbishing a toner cartridge for a printer by forming a permanent deflection, such as a crease, in a toner blade of the toner cartridge.

BACKGROUND

In some laser printers, electrostatically charged toner particles are transferred from a developer roller that is partially exposed to toner inside of the toner cartridge's toner reservoir, to a photoreceptive drum that is also part of the toner cartridge. In some cartridges, a foam toner adder roller is positioned in the supply hopper to pick up toner and push it against the developer roller to ensure that the developer roller has a sufficient toner supply. In some applications, two blades are mounted on the toner reservoir housing and make contact with the developer roller—a doctor blade, which may be made of steel or another substantially rigid material, meters the thickness of the toner layer that can be transferred from the developer roller to the photoreceptive drum, and a sealing blade, which may be made of polyester film or a similarly flexible material, seals the gap between the developer roller and the toner reservoir housing to prevent toner from leaking out of the toner reservoir through the gap.

After the layer of toner is transferred to the developer roller, it is transferred to those areas of the normally negatively charged photoreceptive drum that have been positively charged by the printer's laser beam to correspond to the desired printed image. The negatively charged toner transfers only to those areas of the photoreceptive drum that have been positively charged by the laser beam, and toner is repelled from those areas of the photoreceptive drum that remain negatively charged. After the toner particles are transferred to the photoreceptive drum, they are transferred to the media that is being printed, such as a piece of paper. This transfer is facilitated by a positively charged transfer roller that is located below the media. The transfer roller has a greater positive charge than the positively charged areas of the photoreceptive drum, and therefore pulls the negatively charged toner away from the photoreceptive drum. Ideally, all of the toner on the drum is transferred to the media, but in reality, relatively small amounts of toner can remain attached to the photoreceptive drum instead of being transferred to the paper. After the photoreceptive drum has transferred toner to the media, it passes over a primary charge roller that "erases" the positively charged areas of the photoreceptive drum such that substantially the entire photoreceptive drum is negatively charged. The photoreceptive drum then returns to the laser beam and is selectively positively charged for a subsequent printing cycle.

To prevent errant toner from remaining on the photoreceptive drum after the toner has been transferred to the media, many toner cartridges also incorporate a flexible wiper or wiper blade that is positioned against the photoreceptive drum at a location "upstream" of where the photoreceptive drum contacts the primary charge roller. The wiper blade wipes errant toner that remains attached to the photoreceptive drum into a toner waste reservoir as it passes by the wiper blade. The toner waste reservoir can also be equipped with a recovery blade that functions similar to the sealing blade and seals the gap between the photoreceptive drum and the toner waste reservoir housing to prevent waste toner from leaking out of the waste reservoir.

Used toner cartridges can be refurbished to allow the cartridge to be reused after the initial toner supply has become low or depleted. When a cartridge is refurbished, components of the cartridge such as the various drums and rollers, the doctor blade, the wiper blades, the various sealing and recovery blades, and the like, may be checked to see if they need to be replaced or, if possible, refurbished.

SUMMARY

In some aspects, a method of refurbishing a used toner blade for a toner cartridge is provided and includes obtaining a used toner blade including a fixed portion configured for attachment to a portion of the toner cartridge, and a depending portion extending away from the fixed portion, the depending portion of the used toner blade having a permanent deformation in a first direction as a result of an initial period of use. A permanent deflection is formed between the fixed portion and the depending portion to permanently deflect the depending portion in a second direction opposite the first direction.

The method optionally may include fixturing the toner blade. If the fixed portion of the toner blade is attached to the portion of the toner cartridge, fixturing the toner blade may include fixturing the portion of the toner cartridge. Forming the permanent deflection may include creasing the toner blade. Forming the permanent deflection may further or alternatively include applying localized pressure to the toner blade. Forming the permanent deflection may still further or alternatively include engaging a deflecting die with the toner blade, which may include engaging the deflecting die with the toner blade at a location between the fixed portion and the depending portion. If a deflecting die is used, forming the permanent deflection may include moving the deflecting die along a length of the toner blade. The permanent deflection may be formed substantially adjacent to the fixed portion. Obtaining the used toner blade may include obtaining a used developer roller sealing blade. Obtaining the used toner blade may also or alternatively include obtaining a used toner cartridge to which the toner blade is attached.

In other aspects, a refurbished resilient toner blade for a toner cartridge is provided. The toner blade is substantially planar when new and becomes permanently deformed in a first direction after an initial period of use. The refurbished toner blade includes a fixed portion configured for attachment to a portion of a toner cartridge, a depending portion extending away from the fixed portion, and a permanent deflection formed during refurbishment of the toner blade. The permanent deflection extends between the fixed portion and the depending portion, and deflects the depending portion in a second direction opposite the first direction.

The permanent deflection may include a crease extending along a length of the toner blade. The toner blade may be formed of polyester film. The toner blade may comprise a developer roller sealing blade. The permanent deflection may be substantially adjacent to the fixed portion.

In still other aspects, a refurbished toner cartridge is provided and includes a toner reservoir portion including a body. The body defines a relatively flat shelf portion. A toner adder roller is rotatably supported by the body. A developer roller sealing blade includes a fixed portion attached to the shelf portion, and a depending portion extending away from the fixed portion. The depending portion has a permanent deformation in a first direction as a result of an initial period of use. The sealing blade also includes a permanent deflection formed between the fixed portion and the depending portion. The permanent deflection deflects the depending portion in a second direction opposite the first direction. The permanent deflection may include a crease extending along a length of the developer roller sealing blade, and the toner blade may be formed of polyester film.

BRIEF DESCRIPTION OF THE DRAWINGS

To understand the present invention, it will now be described by way of example only, not by way of limitation, with reference to the accompanying drawings.

DETAILED DESCRIPTION

Figure 1:
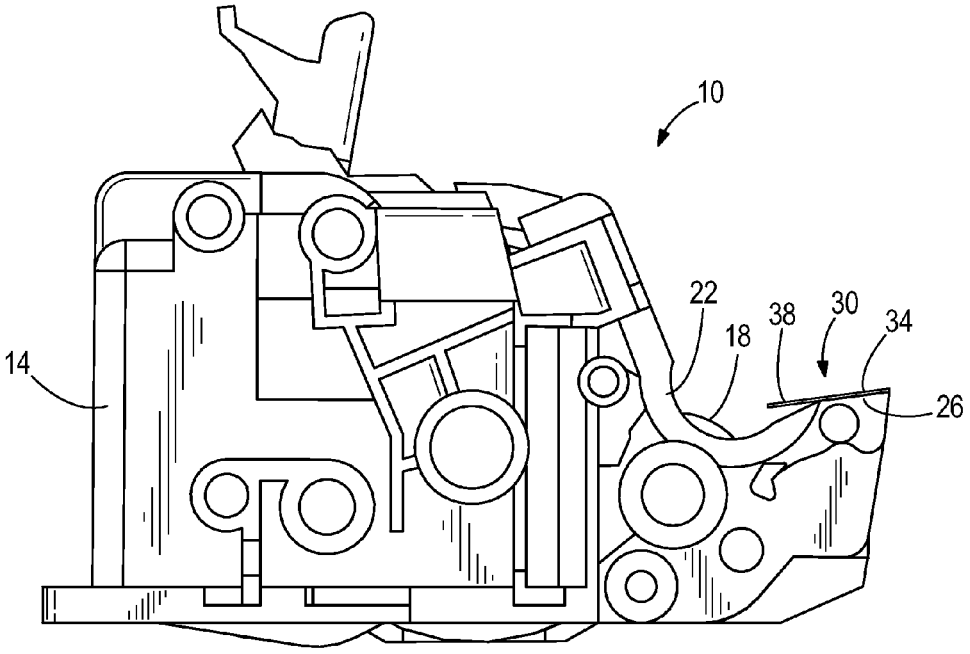
FIG. 1 is an end view of a toner reservoir portion of a new, uninstalled toner cartridge for use in an electrophotographic printer.

While the subject matter of this disclosure can be embodied in many different forms, there is shown in the drawings and will herein be described in detail at least one specific embodiment with the understanding that the present disclosure is to be considered as an exemplification of certain principles and is not intended to limit the broad aspects of the disclosed subject matter to the embodiment(s) illustrated.

As discussed in the foregoing Background section, toner cartridges include several wipers and blades of various configurations that function to regulate or otherwise control the application or removal of toner to or from the various rollers and drums within the toner cartridge. These wipers and blades shall be collectively referred to herein as "toner blades." Of course, different toner cartridges may have different configurations of rollers, wipers, and blades for controlling the application and removal of toner to or from the various drums and rollers in the toner cartridge, which wipers and blades shall also fall within the scope of the term "toner blades" as used herein. Although the following description references a system and method for refurbishing a developer roller sealing blade on the toner reservoir portion of a toner cartridge, the concepts, teachings, and structures discussed herein may also be applied to the refurbishment of other toner blades used in other portions of a toner cartridge.

FIG. 1 illustrates a toner reservoir portion 10 of a toner cartridge for installation in a printer, such as a laser printer. The reservoir portion 10 includes a body 14 and a toner adder roller 18 rotatably supported by the body 14. A curved cradle portion 22 of the body 14 includes a relatively flat shelf portion 26 at one end, and a toner blade in the form of a developer roller sealing blade 30 coupled to the shelf portion 26. The sealing blade 30 includes a fixed portion 34 that is attached to the shelf portion 26, and a depending portion 38 that extends away from the shelf portion 26 toward the toner adder roller 18. The sealing blade 30 can be formed of a variety of materials, however flexible but resilient polyester films such as MYLAR® and the like are frequently used. As shown in FIG. 1, which illustrates a new reservoir portion 10, the sealing blade 30 is substantially flat and planar before the reservoir portion 10 is assembled with the rest of the toner cartridge. The sealing blade 30 can be attached to the shelf portion 26 of the body 14 in a variety of ways. For example, in some embodiments double-sided adhesive tape attaches the fixed portion 34 of the sealing blade 30 to the shelf portion 26.

Figure 2:
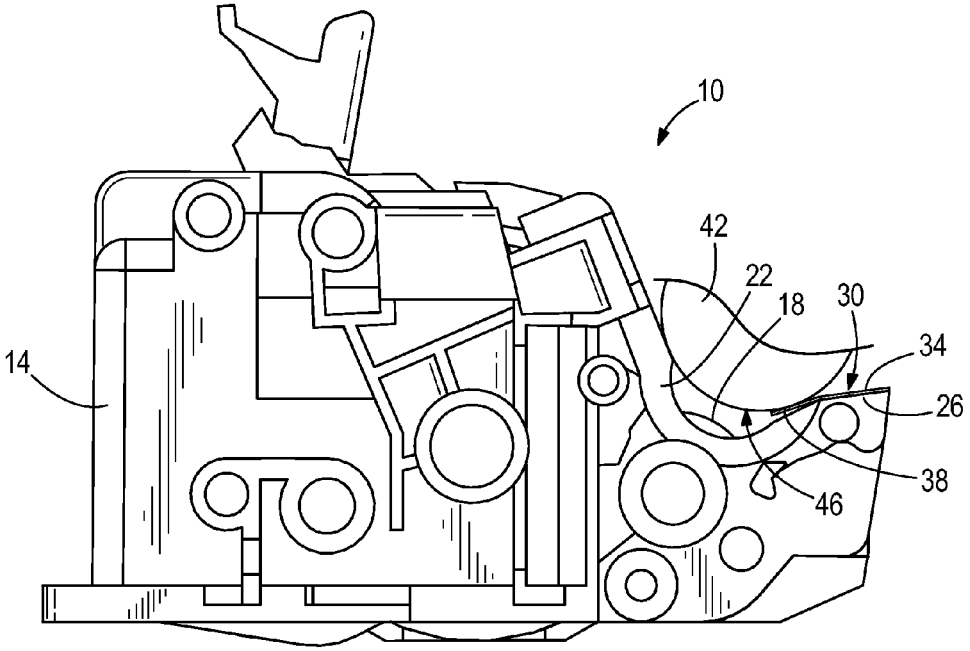
FIG. 2 is an end view similar to FIG. 1 and showing the toner reservoir portion assembled with other portions of the toner cartridge.

Referring also to FIG. 2, which shows the reservoir portion 10 assembled with the rest of the toner cartridge, the cradle portion 22 is configured to receive a developer roller 42. The developer roller 42 fits within the cradle portion 22 and engages the toner adder roller 18. The depending portion 38 of the sealing blade 30 engages an outer surface 46 of the developer roller 42 and is deflected in a first direction, e.g. generally downwardly as viewed in FIGS. 1-4. Because the sealing blade 30 is inherently resilient, the depending portion 38 is biased against the outer surface 46 of the developer roller 42. During operation, as the developer roller 42 rotates it picks up toner from the toner adder roller 18. The thickness of the toner applied to the developer roller 42 is subsequently metered by a doctor blade (not shown) and transferred to the positively charged areas of a photoreceptive drum (not shown). The sealing blade 30 maintains pressure against the "upstream" side of the developer roller 42 to prevent substantial leakage of toner from the reservoir portion 10.

Figure 3:
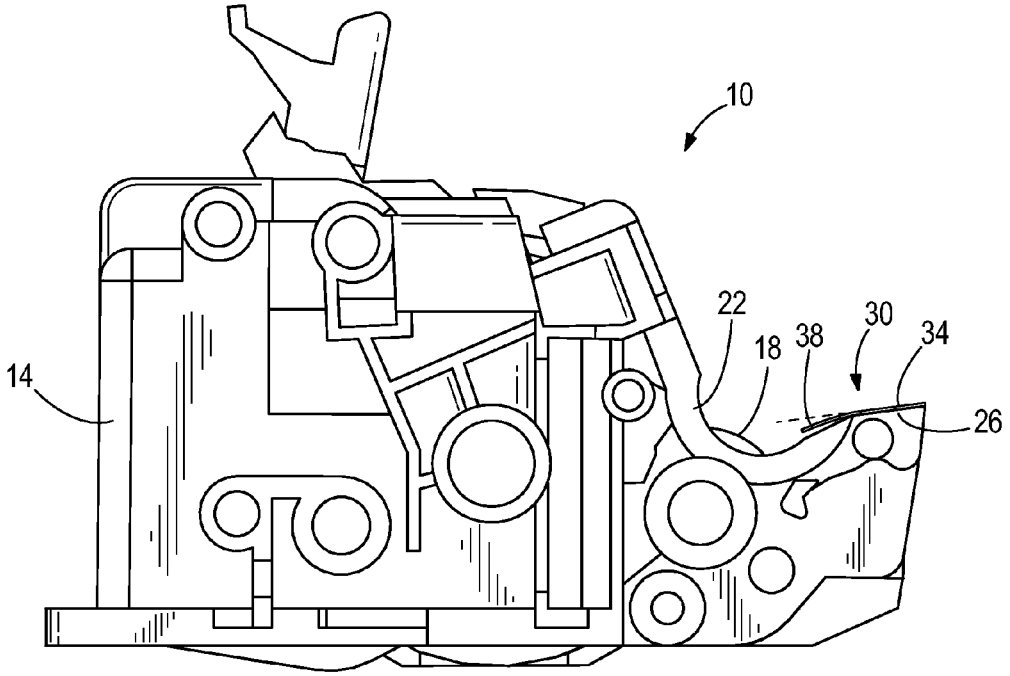
FIG. 3 is an end view similar to FIGS. 1 and 2 showing a used toner reservoir portion that has been removed from a toner cartridge and in which a developer roller sealing blade has become permanently deformed.

Referring also to FIG. 3, although the sealing blade 30 is inherently resilient, after an extended period of operation where the depending portion 38 is in contact with the developer roller 42, the sealing blade 30 can lose some of its resiliency and take on a permanent bend in the first direction (downwardly in FIGS. 1-4). Thus, in some used toner reservoir portions 10, the depending portion 38 may remain in the downwardly deflected position shown in FIG. 3 when the sealing blade 30 is disengaged from the developer roller 42. As a result, if a used reservoir portion 10 having a downwardly deflected depending portion 38 like that shown in FIG. 3 is re-installed into a toner cartridge, the depending portion 38 of the sealing blade 30 may be less firmly biased against the outer surface 46 of the developer roller 42 than when the toner reservoir portion 10 was new. Because the depending portion 38 is less firmly biased against the outer surface 46 of the developer roller 42, the ability of a used sealing blade 30 to keep toner from leaking out of the reservoir portion 10 may be reduced, possibly resulting in an unacceptable degradation of print quality or an undesirable leaking of toner from the print cartridge as a whole.

Figure 4:
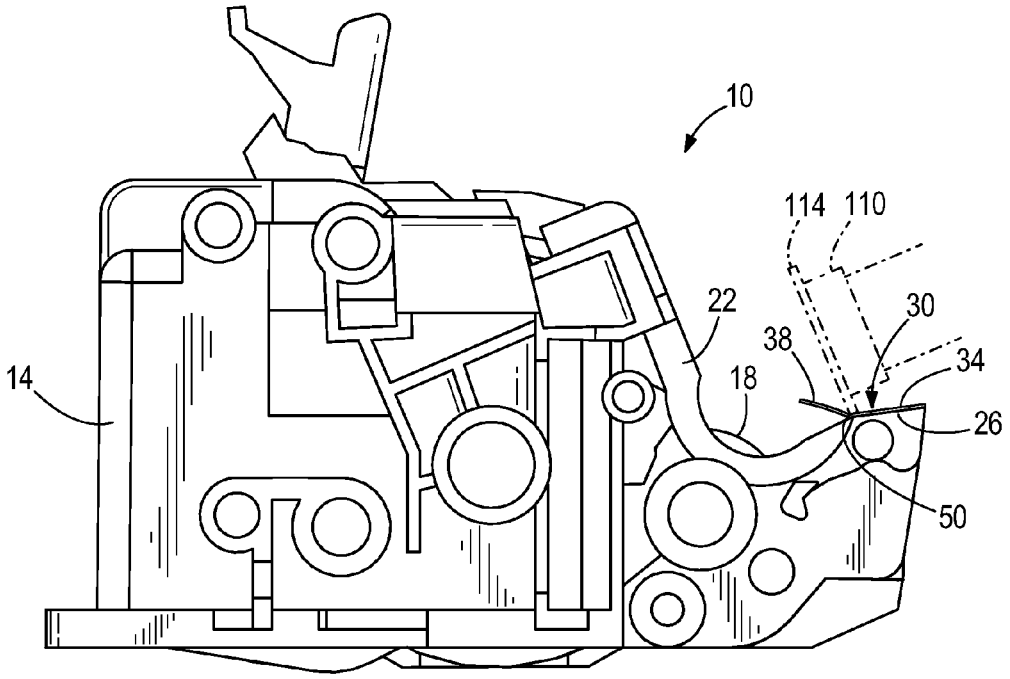
FIG. 4 is an end view similar to FIGS. 1, 2, and 3 showing a used toner reservoir portion that has been refurbished by deflecting the sealing blade.

Referring also to FIG. 4, which shows a used but refurbished toner reservoir portion 10, a substantially permanent deflection 50 has been formed in the depending portion 38 of the sealing blade 30 substantially adjacent to the shelf portion 26 of the toner reservoir body 14. The deflection 50 in the illustrated sealing blade 30 is in the form of a fairly sharp crease. However, the deflection 50 could also be in the form of a less pronounced but still substantially permanent bend, curve, or rounded portion to obtain similar results. As shown, the deflection 50 extends between the fixed portion 34 and the depending portion of the sealing blade 30, and deflects the depending portion 38 in a second direction, e.g. generally upwardly as viewed in FIGS. 1-4. Thus, even though the depending portion 38 has taken on a permanent downward bend due to extended use before its refurbishment, when the refurbished toner reservoir portion 10 is assembled with other components to produce a remanufactured toner cartridge, the upwardly-deflected depending portion 38 is firmly biased against the outer surface 46 of the developer roller 42 to prevent substantial leakage of toner from the reservoir portion 10. The performance of the refurbished toner reservoir portion 10 may be similar to or better than the performance of a new toner reservoir portion 10 having a new, substantially flat sealing blade 30, like that shown in FIG. 1. Creasing the used sealing blade 30 can eliminate the need to completely replace a used and deformed sealing blade 30 with a new sealing blade 30 during the refurbishment process.

Figure 5:
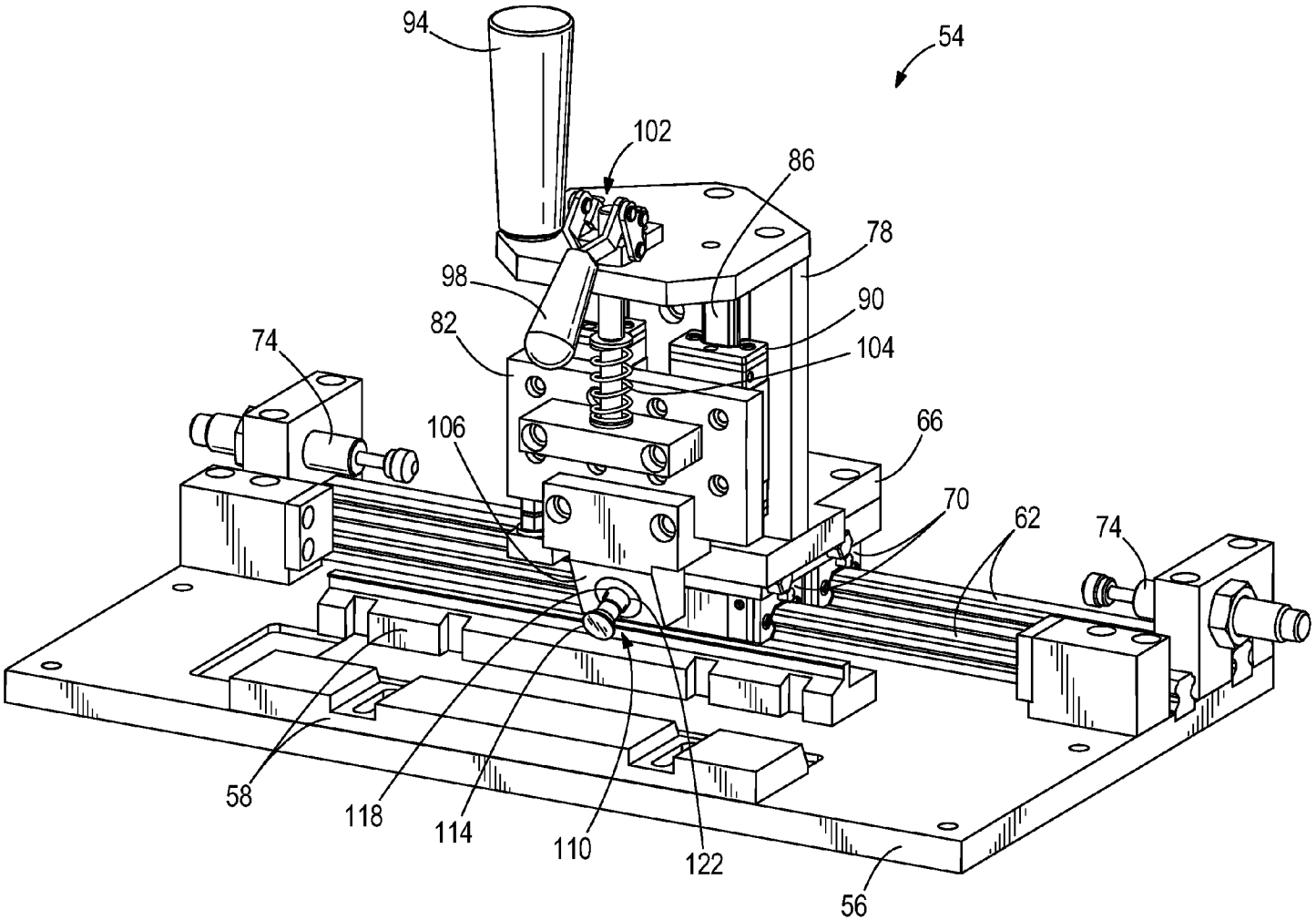
FIG. 5 is a front perspective view of a first device for deflecting a developer roller sealing blade of a toner cartridge.
Figure 6:
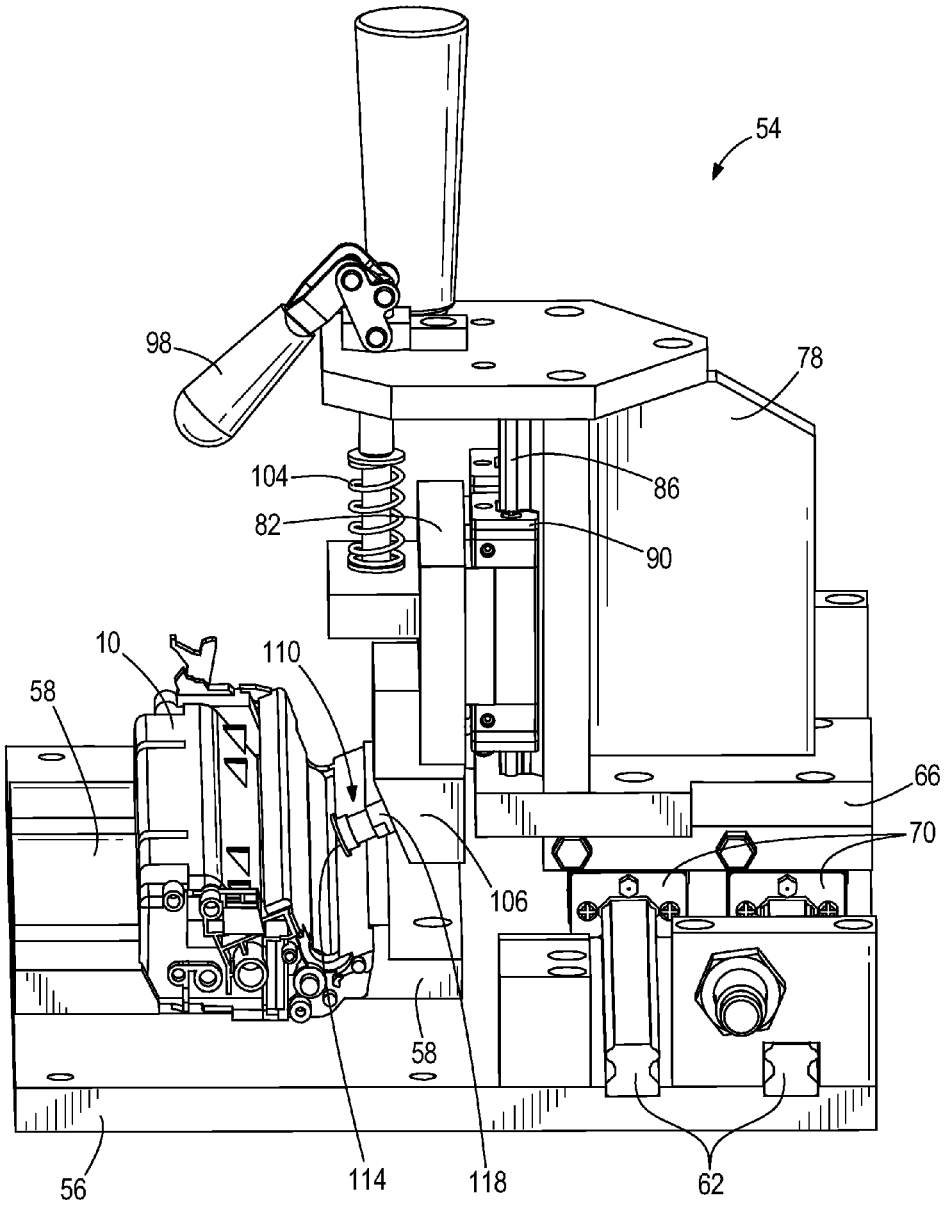
FIG. 6 is a side perspective view of the first device of FIG. 5 with a toner reservoir portion of a toner cartridge positioned for deflecting of the developer roller sealing blade.

Referring now to FIGS. 5 and 6, one exemplary device 54 for forming the deflection 50 in the sealing blade 30 includes a base plate 56, a pair of fixturing cleats 58, a pair of rails 62, and a carriage 66 slidably mounted to the rails 62. The base plate 56 allows the device 54 to be secured to a work surface. The cleats 58 are configured for fixturing a toner reservoir portion 10 with respect to the base plate 56, as shown in FIG. 6. It should be appreciated, however, that the cleats 58 could be reconfigured to fixture other portions of a toner cartridge having other toner blades for refurbishment in accordance with the present teachings. The carriage 66 includes linear bearings 70 that ride along the rails 62 and cooperate therewith to guide the carriage 66 for substantially linear, lateral movement during a deflecting operation. Bumpers 74 may be provided at the ends of the rails 62 to limit lateral movement of the carriage 66.

The carriage 66 includes an upright assembly 78 to which a sub-carriage 82 is slidably mounted by way of rails 86 and linear bearings 90 similar to those used to mount the carriage 66 to the base plate 56. The rails 86 and linear bearings 90 are arranged to provide substantially vertical sliding movement of the sub-carriage 82 with respect to the carriage 66 in a direction that is substantially perpendicular the lateral direction of movement of the carriage 66. The upright assembly 78 includes a first handle 94 for sliding the carriage 66 laterally along the rails 62 during a creasing operation. The upright assembly 78 also includes a second handle 98 for moving the sub-carriage 82 substantially vertically between a raised position that allows for loading and unloading of the toner reservoir portion 10, and a lowered position for performing the creasing or deflecting operation, the lowered position being shown in FIGS. 5 and 6. The second handle 98 is coupled to the upright assembly 78 by an over-center linkage mechanism 102 configured to detently secure the sub-carriage 82 in the fully raised and fully lowered positions. A spring 104 or other biasing member may be interposed between the over-center linkage mechanism 102 and the sub-carriage to permit a controlled amount of relative movement between the sub-carriage 82 and the upright assembly 78 when the sub-carriage 82 is in the lowered position, as discussed further below. Although the illustrated device 54 is configured for manual operation, it should be appreciated that suitable motors, actuators, controllers, and the like could be incorporated into the device for automation of one or more steps of the deflecting operation.

The sub-carriage 82 includes an angled support block 106 that rotatably supports a deflecting die 110. The deflecting die 110 is generally cylindrical and includes an enlarged, disk-like end 114 that engages the sealing blade 30 during a deflecting operation, as shown in phantom in FIG. 4. The deflecting die 110 also includes a reduced shaft portion 118 extending away from the end 114 and rotatably mounted within the support block 106 by a bearing 122. While the illustrated deflecting die 110 includes a generally cylindrical end 114, other end configurations are also possible including, for example, frusto-conical ends, ends having a rounded outer circumference, and the like. The support block 106 can be configured to include a collet, set screws, or similar features to allow for the exchange of differently configured deflecting dies 110 for the deflecting, creasing, or bending of different types of toner blades.

In operation, with the sub-carriage 82 in the raised position, a toner reservoir portion 10 is secured to the fixturing cleats 58, which properly locate the toner reservoir portion 10 and, more specifically, the shelf portion 26 and the sealing blade 30, with respect to the carriage 66. The second handle 98 is operated to move the sub-carriage 82 to the lowered position, which engages the deflecting die 110 with the sealing blade 30 as shown in FIG. 4. In some embodiments, the deflecting die 110 presses the sealing blade 30 against the shelf portion 26 of the toner reservoir portion 10 to form the deflection.

As mentioned above, the over-center linkage mechanism 102 detently secures the sub-carriage 82 in the lowered position, which presses the deflecting die 110 generally downwardly against the sealing blade 30. The pressure applied to the sealing blade 30 can thus be regulated or controlled by adjusting the over-center linkage mechanism 102 and through selection of an appropriate spring 104. The first handle 94 is then operated to move the carriage 66 laterally along the rails 62. As the carriage 66 moves laterally along the rails 62, the deflecting die 110, which is pressed against the sealing blade 30, forms the deflection 50 in the sealing blade 30. The bearing 122 allows the deflecting die 110 to rotate as it moves along the sealing blade 30, thereby reducing the likelihood of damaging the sealing blade 30 during the deflecting operation. In addition, the spring 104 permits a limited amount of substantially vertical deflection of the sub-carriage 82 and deflecting die 110 as the carriage 66 moves laterally along the rails 62, thereby allowing the deflecting die 110 to conform to minor irregularities that may be present along the length of the shelf portion 26. The carriage 66 is moved side-to-side between the bumpers 74 one or more times to apply the deflection 50 along the entire length of the sealing blade 30, or at least along the portion of the length of the sealing blade that contacts the developer roller 42. In some constructions, the bumpers 74 can be adjusted to change the limits of lateral movement of the carriage 66 to accommodate toner cartridge components of different sizes. After the deflection 50 has been applied to the sealing blade 30, the second handle 98 is operated to move the sub-carriage 82 to the raised position, and the toner reservoir portion 10 with the now deflected sealing blade 30 can be removed from the fixturing cleats 58.

Figure 7:
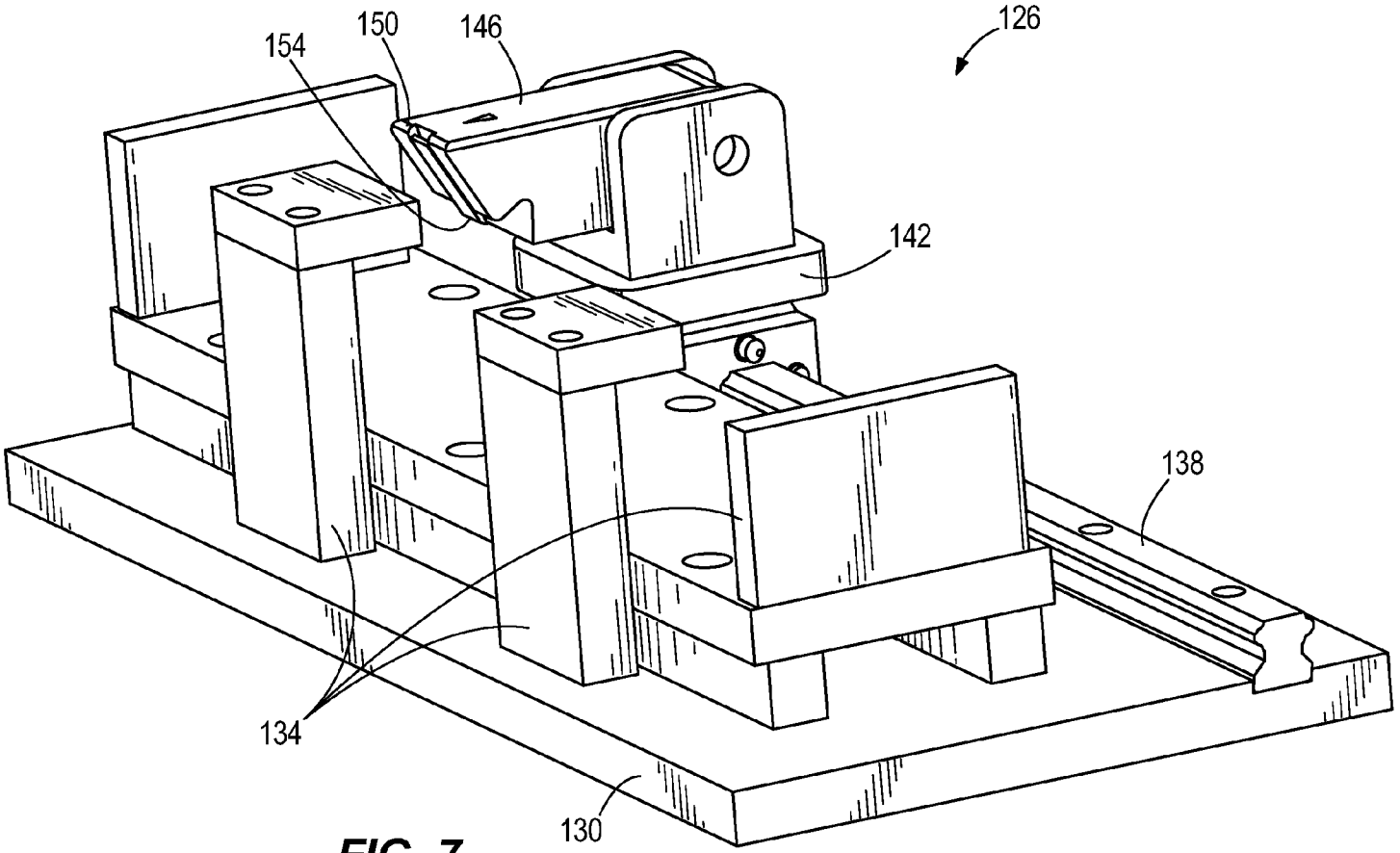
FIG. 7 is a perspective view of a second device for deflecting a developer roller sealing blade of a toner cartridge.

Referring now to FIG. 7, a second exemplary device 126 for deflecting the sealing blade 30 includes a base plate 130, fixturing cleats 134, a rail 138, and a carriage 142 slidably mounted to the rail 138. An arm 146 is pivotally mounted to the carriage 142 and includes a distal end 150 having a deflecting die 154 coupled thereto. Unlike the device 54, which has the rotatable deflecting die 110 mounted on the vertically moveable sub-carriage 86, the device 126 includes the substantially fixed deflecting die 154 mounted on the pivoting arm 146. Operation of the device 126 includes pivoting the arm 146 rearwardly so the toner reservoir portion 10 can be positioned in the fixturing cleats 134. The arm 146 is then pivoted forwardly to bring the deflecting die 154 into engagement with the sealing blade 30 of the toner reservoir portion 10, and the carriage 142 is moved laterally along the rail 138 to form the deflection 50 in the sealing blade 30. After forming the deflection 50 in the sealing blade 30, the arm 146 can be pivoted rearwardly and the toner reservoir portion 10 can be removed from the fixturing cleats 134.

Although the illustrated devices of FIGS. 5-7 are configured to form a relatively sharp crease in the sealing blade 30, it should be appreciated that similar devices could also be used to form alternative types of deflections, such as bends and/or curves, in the sealing blade 30 or in other types of toner blades. For example, by changing the configuration of the deflecting dies 110, 154, rather than creasing the sealing blade 30, the sealing blade 30 could be bent or curved in a desired fashion. Moreover, the specific configuration of the deflecting dies 110, 154 can be changed to accommodate other toner blades that are formed of different types of materials and that may be thicker or thinner than the illustrated sealing blade 30. In some embodiments, the deflecting die 110, 154 may also be heated to further aid in forming a deflection in the sealing blade 30 or other toner blade. In still other embodiments, the sealing blade 30 or other toner blade may be heated using a heat gun, heating iron, or similar device to further aid in forming a deflection of a desired configuration. While the illustrated devices of FIGS. 5-7 are configured such that the deflecting dies 110, 154 move with respect to the base plate 130 and the toner blade, other configurations may include a moveable fixture that moves the toner blade with respect to a deflecting die 110, 154 that is substantially fixed with respect to the base plate 130.

Several alternative examples have been described and illustrated herein. A person of ordinary skill in the art would appreciate the features of the individual embodiments, and the possible combinations and variations of the components. A person of ordinary skill in the art would further appreciate that any of the examples could be provided in any combination with the other examples disclosed herein. The term "plurality" as used herein indicates any number greater than one, either disjunctively or conjunctively, as necessary, up to an infinite number. Additionally, the word "including" as used herein is utilized in an open-ended manner.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A method of refurbishing a used toner blade for a toner cartridge, the method comprising:

obtaining a used toner blade including a fixed portion configured for attachment to a portion of the toner cartridge, and a depending portion extending away from the fixed portion, the depending portion of the used toner blade having a permanent deformation in a first direction as a result of an initial period of use; and, forming a permanent deflection between the fixed portion and the depending portion to permanently deflect the depending portion in a second direction opposite the first direction, wherein forming the permanent deflection includes creasing the toner blade.

2. The method of claim 1, further comprising fixturing the toner blade.

3. The method of claim 2, wherein the fixed portion of the toner blade is attached to the portion of the toner cartridge, and wherein fixturing the toner blade includes fixturing the portion of the toner cartridge.

4. The method of claim 1, wherein forming the permanent deflection includes applying localized pressure to the toner blade.

5. The method of claim 1, wherein forming the permanent deflection includes engaging a deflecting die with the toner blade.

6. The method of claim 5, wherein the deflecting die is engaged with the toner blade at a location between the fixed portion and the depending portion.

7. The method of claim 5, wherein forming the permanent deflection further includes moving the deflecting die along a length of the toner blade.

8. The method of claim 1, wherein forming the permanent deflection includes forming the permanent deflection substantially adjacent to the fixed portion.

9. The method of claim 1, wherein obtaining the used toner blade includes obtaining a used developer roller sealing blade.

10. The method of claim 1, wherein obtaining the used toner blade includes obtaining a used toner cartridge to which the toner blade is attached.

11. A refurbished resilient toner blade for a toner cartridge, the toner blade being substantially planar when new and becoming permanently deformed in a first direction after an initial period of use, the refurbished toner blade comprising:

a fixed portion configured for attachment to a portion of a toner cartridge;

a depending portion extending away from the fixed portion; and, a permanent deflection comprising a crease extending along a length of the toner blade, the permanent deflection formed during refurbishment of the toner blade, the permanent deflection extending between the fixed portion and the depending portion, and deflecting the depending portion in a second direction opposite the first direction.

12. The toner blade of claim 11, wherein the toner blade is formed of polyester film.

13. The toner blade of claim 11, wherein the toner blade comprises a developer roller sealing blade.

14. The toner blade of claim 11, wherein the permanent deflection is substantially adjacent to the fixed portion.

15. A refurbished toner cartridge comprising:

a toner reservoir portion including a body, the body defining a relatively flat shelf portion;

a toner adder roller rotatably supported by the body; and a developer roller sealing blade including a fixed portion attached to the shelf portion, a depending portion extending away from the fixed portion and having a permanent deformation in a first direction as a result of an initial period of use, and a permanent deflection formed between the fixed portion and the depending portion, wherein the permanent deflection deflects the depending portion in a second direction opposite the first direction.

16. The refurbished toner cartridge of claim 15, wherein the permanent deflection comprises a crease extending along a length of the developer roller sealing blade.

17. The refurbished toner cartridge of claim 15, wherein the toner blade is formed of polyester film.

18. A method of refurbishing a used toner blade for a toner cartridge, the method comprising:

obtaining a used toner blade including a fixed portion configured for attachment to a portion of the toner cartridge, and a depending portion extending away from the fixed portion, the depending portion of the used toner blade having a permanent deformation in a first direction as a result of an initial period of use; and, forming a permanent deflection between the fixed portion and the depending portion to permanently deflect the depending portion in a second direction opposite the first direction, wherein forming the permanent deflection includes engaging a deflecting die with the toner blade.

19. The method of claim 18, further comprising fixturing the toner blade.

20. The method of claim 19, wherein the fixed portion of the toner blade is attached to the portion of the toner cartridge, and wherein fixturing the toner blade includes fixturing the portion of the toner cartridge.

21. The method of claim 18, wherein forming the permanent deflection includes applying localized pressure to the toner blade.

22. The method of claim 18, wherein the deflecting die is engaged with the toner blade at a location between the fixed portion and the depending portion.

23. The method of claim 18, wherein forming the permanent deflection further includes moving the deflecting die along a length of the toner blade.

24. The method of claim 18, wherein forming the permanent deflection includes forming the permanent deflection substantially adjacent to the fixed portion.

25. The method of claim 18, wherein obtaining the used toner blade includes obtaining a used developer roller sealing blade.

26. The method of claim 18, wherein obtaining the used toner blade includes obtaining a used toner cartridge to which the toner blade is attached.

27. A method of refurbishing a used toner blade for a toner cartridge, the method comprising:

obtaining a used developer roller sealing blade including a fixed portion configured for attachment to a portion of the toner cartridge, and a depending portion extending away from the fixed portion, the depending portion of the used developer roller sealing blade having a permanent deformation in a first direction as a result of an initial period of use; and, forming a permanent deflection between the fixed portion and the depending portion to permanently deflect the depending portion in a second direction opposite the first direction.

28. The method of claim 27, further comprising fixturing the used developer roller sealing blade.

29. The method of claim 28, wherein the fixed portion of the used developer roller sealing blade is attached to the portion of the toner cartridge, and wherein fixturing the used developer roller sealing blade includes fixturing the portion of the toner cartridge.

30. The method of claim 27, wherein forming the permanent deflection includes applying localized pressure to the used developer roller sealing blade.

31. The method of claim 27, wherein forming the permanent deflection includes forming the permanent deflection substantially adjacent to the fixed portion.

32. The method of claim 27, wherein obtaining the used developer roller sealing blade includes obtaining a used toner cartridge to which the toner blade is attached.

33. A refurbished resilient toner blade for a toner cartridge, the toner blade being substantially planar when new and becoming permanently deformed in a first direction after an initial period of use, the refurbished toner blade comprising:

a fixed portion configured for attachment to a portion of a toner cartridge;

a depending portion extending away from the fixed portion; and, a permanent deflection formed during refurbishment of the toner blade, the permanent deflection extending between the fixed portion and the depending portion, and deflecting the depending portion in a second direction opposite the first direction; and, wherein the toner blade comprises a developer roller sealing blade.

34. The toner blade of claim 33, wherein the toner blade is formed of polyester film.

35. The toner blade of claim 33, wherein the permanent deflection is substantially adjacent to the fixed portion.

* * * * *